US005989447A

United States Patent [19]

Podszun et al.

[11] Patent Number: 5,989,447

[45] Date of Patent: Nov. 23, 1999

[54] MAGNETORHEOLOGICAL LIQUIDS, A PROCESS FOR PRODUCING THEM AND THEIR USE, AND A PROCESS FOR PRODUCING MAGNETIZABLE PARTICLES COATED WITH AN ORGANIC POLYMER

[75] Inventors: Wolfgang Podszun; Olaf Halle, both of Köln; Johan Kijlstra, Leverkusen; Robert Bloodworth, Köln; Eckhard Wendt, Leverkusen, all of Germany

[73] Assignee: G E Bayer Silicones GmbH & Co. KG, Erkrath, Germany

[21] Appl. No.: 08/976,555

[22] Filed: Nov. 24, 1997

[30] Foreign Application Priority Data

Nov. 28, 1996 [DE] Germany ..... 196 49 321

[51] Int. Cl.[6] ..... H01F 1/44; H01F 1/06

[52] U.S. Cl. ..... 252/62.52; 252/62.54

[58] Field of Search ..... 252/62.52, 62.54; 428/403, 405

[56] References Cited

U.S. PATENT DOCUMENTS

| | | | |
|---|---|---|---|
| 4,339,337 | 7/1982 | Tricot et al. | 252/62.54 |
| 4,369,265 | 1/1983 | Buxbaum et al. | 523/212 |
| 4,820,338 | 4/1989 | Ochiai et al. | 252/62.54 |
| 4,832,891 | 5/1989 | Kass | 252/62.54 |
| 4,992,190 | 2/1991 | Shtarkman | 252/62.52 |
| 5,082,581 | 1/1992 | Yabe et al. | 252/62.54 |
| 5,167,850 | 12/1992 | Shtarkman | 252/62.52 |
| 5,198,137 | 3/1993 | Rutz et al. | 252/62.54 |
| 5,240,626 | 8/1993 | Thakur et al. | 252/62.54 |
| 5,354,488 | 10/1994 | Shtarkman et al. | 252/62.56 |
| 5,356,713 | 10/1994 | Charmot et al. | 252/62.54 |
| 5,578,238 | 11/1996 | Weiss et al. | 252/62.52 |
| 5,583,056 | 12/1996 | Brouwer | 252/62.54 |
| 5,599,474 | 2/1997 | Weiss et al. | 252/62.52 |
| 5,693,250 | 12/1997 | El-Antably et al. | 252/62.54 |

FOREIGN PATENT DOCUMENTS

| | | |
|---|---|---|
| 0156537 | 10/1985 | European Pat. Off. . |
| 4130268 | 3/1992 | Germany . |
| 9410693 | 5/1994 | WIPO . |

OTHER PUBLICATIONS

Patent abstracts of Japan: abstract for 3–210602, Sep. 27, 1991.

Patent Abstracts of Japan, Publication No. :03219602, Publication Date: Sep. 27, 1991, Application No.: 02013674, Inventor: Ogawa Masahiro, Title: Magnetic–Particle Fluid.

*Primary Examiner*—C. Melissa Koslow

*Attorney, Agent, or Firm*—Sprung Kramer Schaefer & Biscoe

[57] ABSTRACT

Magnetorheological liquids, a process for producing them, their use and a process for producing polymer-coated magnetisable particles used in the magnetorheological liquids.

9 Claims, No Drawings

MAGNETORHEOLOGICAL LIQUIDS, A PROCESS FOR PRODUCING THEM AND THEIR USE, AND A PROCESS FOR PRODUCING MAGNETIZABLE PARTICLES COATED WITH AN ORGANIC POLYMER

This invention relates to new magnetorheological liquids, to a process for producing them and to their use, and to a process for producing magnetisable particles coated with an organic polymer.

Dispersions which consist of a carrier liquid and magnetisable particles dispersed therein are described as magnetorheological liquids (MRLs). The flow behaviour of these dispersions changes when a magnetic field is applied. Examples of possible areas of use for magnetorheological liquids include couplings, dampers and bearings.

Paramagnetic, superparamagnetic and ferromagnetic materials have hitherto been employed as the magnetisable particles for use in magnetorheological liquids.

Despite extensive research in this field, no success has been achieved in satisfactorily solving the problem of stability with regard to settling. The methods known hitherto, such as the addition of carbon fibres according to U.S. Pat. No. 5,167,850, silica gel according to U.S. Pat. No. 4,992,190, or polystyrene beads have resulted in slight improvements only.

Another problem with magnetorheological liquids, which has also not been solved satisfactorily, is their abrasiveness. This is particularly critical, since it can result in the premature failure of the device which is operated with the magnetorheological liquid.

Even the magnetisable particles described in U.S. Pat. No. 5,354,488, which are coated with an isolating cladding of silica, no not exhibit any improvement as regards their abrasiveness.

There is therefore a need for magnetorheological liquids which exhibit reduced abrasiveness and a high stability with regard to settling.

The object of the present invention is therefore to provide MRLs which do not have the disadvantages known in the prior art.

It has now been found that magnetorheological liquids which contain magnetisable particles coated with an organic polymer exhibit improved colloidal stability, improved stability with regard to settling and reduced abrasiveness.

The present invention therefore relates to magnetorheological liquids comprising magnetisable particles, at least one oleophilic liquid and optionally a thickener, characterised in that the magnetisable particles are coated with an organic polymer.

The magnetorheological liquids which are preferred are those which contain 45 to 95% by weight, more preferably 60 to 95% by weight, most preferably 75–95% by weight, of the magnetisable particles coated with an organic polymer, and which contain 2 to 45% by weight of an oleophilic liquid and 0 to 20% by weight of a thickener, wherein the sum of the percentages by weight is 100% by weight of magnetorheological liquid.

Magnetisable particles in the sense of the present invention are paramagnetic, superparamagnetic and ferromagnetic materials. The following can be cited as examples: iron, iron nitride, iron carbide, steel of carbon content lower than 1%, nickel and cobalt. Mixtures of the said materials are also suitable, as are alloys of iron with aluminium, silicon, cobalt, nickel, vanadium, molybdenum, chromium, tungsten and manganese. Iron-nickel alloys and iron-cobalt alloys can be cited as alloys which are well suited for this purpose. Magnetic oxides of chromium and iron are also suitable, such as chromium dioxide, gamma-$Fe_2O_3$ and $Fe_3O_4$.

Iron and/or iron alloys are the preferred magnetisable particles in this connection.

What is termed carbonyl iron, are small spherical iron particles, which are obtained by the thermal decomposition of iron(0) pentacarbonyl, is particularly preferred.

The average longest dimension based on their weight (weight average) of the magnetisable particles according to the invention which are coated with an organic polymer is preferably 0.1 to 100 $\mu$m, most preferably 1 to 50 $\mu$m.

The shape of the magnetisable particles may be irregular, rod-like or acicular. A spherical shape or a shape similar to a spherical shape is particularly preferred if the object is to achieve high degrees of filling.

Organic polymers in the sense of the invention are natural polymers, such as gelatine or cellulose for example, modified natural polymers, particularly cellulose derivatives, and synthetic polymers. Synthetic polymers are preferred.

In this connection, the term "gelatine" comprises gelatine coacervates and gelatine-like complex coacervates. Combinations of gelatine with synthetic polyelectrolytes are particularly preferred as complex coacervates containing gelatine. Suitable synthetic polyelectrolytes are those which are produced by the homo- or copolymerisation of maleic acid, acrylic acid, methacrylic acid, acrylamide and methacrylamide, for example. The term "gelatine" also comprises gelatine which is further crosslinked with customary hardeners, such as formaldehyde or glutaraldehyde for example.

The following can be cited as suitable synthetic polymers: polyesters, polyurethanes, particularly polyester urethanes and polyether urethanes, polycarbonates, polyester-polycarbonate copolymers, polyureas, melamine resins, polysiloxanes, fluoropolymers and vinyl polymers. The following can be cited as examples of suitable vinyl polymers: polyvinyl chloride, polyvinyl esters such as polyvinyl acetate for example, polystyrene, polyacrylic esters such as polymethyl methacrylate, polyethyl hexyl acrylate, polylauryl methacrylate, polystearyl methacrylate or polyethyl acrylate for example, and polyvinyl acetals such as polyvinyl butyral. Other suitable synthetic polymers include co- or terpolymers of different vinyl and vinylidene monomers, such a polystyrene-co-acrylonitrile for example, and copolymers of (meth)acrylic acid and (meth)acrylic esters. Vinyl polymers, polyureas and/or polyurethanes are the organic polymers which are particularly preferred in this respect.

The polymer can have any desired molecular weight for the present field of application. Suitable polymers usually have a weight average of 30,000–1,000,000 daltons. The polymers can also be crosslinked.

The magnetorheological liquids according to the invention preferably contain, as the oleophilic liquid (carrier liquid), mineral oils, paraffin oils, hydraulic oils, what are termed transformer oils which contain chlorinated aromatic compounds and which are characterised by their highly insulating properties and high temperature-resistance, as well as chlorinated and fluorinated oils. Silicone oils, fluorinated silicone oils, polyethers, fluorinated polyethers and polyether-polysiloxane copolymers are also preferred. The viscosity of the carrier liquid is preferably 1 to 1000 mPas, most preferably 3 to 800 mPas, as measured at 25° C.

In one particularly preferred embodiment of the invention, the magnetorheological liquids contain at least one mineral oil or at least one silicone oil as the carrier liquid.

In a further preferred embodiment of the invention, the magnetorheological liquids according to the invention additionally contain at least one thickener which imparts thixotropic properties to the magnetorheological liquid and increases the stability of the magnetisable particles with regard to settling. Examples of thickeners include finely divided inorganic or organic microparticles. Those which are preferred are gels, silicates such as bentonite, metal oxides such as titanium dioxide, alumina or silica, and/or microdispersed hydrated silicas obtained by flame hydrolysis, which are commercially available under the trade names Aerosil® or HDK® from Degussa AG, Germany and from Wacker GmbH, Germany, respectively for example, in which all the microparticles have an average particle diameter less than 1 $\mu$m.

In this preferred embodiment, the amount of thickener is 0.1 to 20% by weight of magnetorheological liquid, preferably 0.5 to 5% by weight of magnetorheological liquid.

The magnetorheological liquids according to the invention may also contain dispersing agents. Examples of dispersing agents include lecithin, oleic acid and oleates such as iron oleate, fatty acids, alkali soaps such as lithium stearate, sodium stearate or aluminium tristearate, sulphonates and phosphonates containing lipophilic radicals, and glycerol esters such as glycerol monostearate.

The dispersing agents are preferably present in amounts of 0.01 to 2% by weight, most preferably 0.1 to 0.5% by weight, with respect to the weight of magnetisable particles.

The proportion by weight of the coating of the magnetisable particles coated with organic polymer is 0.1 to 50% by weight, preferably 0.5 to 20% by weight of coated particles.

The present invention additionally relates to a process for producing the magnetisable particles coated with organic polymers, in which the organic polymer is deposited in molten form or from a solvent, by precipitation or evaporation, on the magnetisable particles.

The present invention also relates to a further process for producing the magnetisable particles coated with organic polymers, in which organic monomer constituents are reacted in the presence of the magnetisable particles by means of polycondensation, polyaddition or polymerisation to form an organic polymer on the particles.

As the organic monomer constituents, a combination of aliphatic diols and aromatic or aliphatic dicarboxylic acids or dicarboxylchlorides is preferred for polycondensation for example, a combination of diols, polyester- and/or polyether diols with di- and/or triisocyanates is preferred for polyaddition, for example, and olefinically unsaturated compounds such as styrene, acrylic acid esters, methacrylic acid esters and/or vinyl acetate are preferred for polymerisation, for example.

Customary reaction conditions can be employed for polycondensation, poly-addition or polymerisation.

It has been found that polymer coatings which adhere to the particles particularly well can be obtained if the magnetisable particles are silanised before coating with the polymer. Silanisation is understood to mean surface treatment with silanes, wherein silanes are preferably used which contain at least one functional group, such as OH or Cl for example.

In one preferred embodiment of the invention, the magnetisable particles are silanised before coating, with a silane of formula (I)

(I)

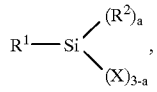

where $R^1$ represents a $C_1$–$C_{20}$ alkyl radical or a $C_2$–$C_{20}$ alkylene radical which may optionally be substituted with an amino, isocyanato, methacryloyloxy, acryloyloxy, epoxy or mercapto group, and/or interrupted by —O—, —NH—, —COO— or —NH—COO, $R^2$ represents a phenyl, a $C_1$–$C_{18}$ alkyl radical or a $C_2$–$C_{18}$ alkylene radical, X represents a hydrolysable group, and a assumes the value 0, 1 or 2.

Examples of $R^1$ radicals include methyl, ethyl, propyl, n-butyl, tert.-butyl, hexyl, octyl, ethylhexyl, decyl, dodecyl, stearyl, vinyl or allyl. The following can be cited as examples of substituted $R_1$ radicals:

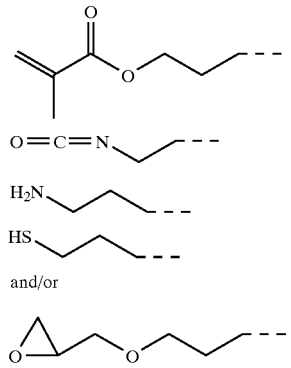

and/or $R^2$ is preferably a phenyl or a $C_1$–$C_6$ alkyl radical, such as methyl, ethyl, propyl, n-butyl, tert.-butyl, pentyl or hexyl for example.

Examples of the hydrolysable groups on the Si atom which are symbolised by X comprise halogen atoms, particularly chlorine and bromine, $C_1$–$C_6$ alkoxy groups, preferably methoxy and ethoxy, and carboxylate groups such as acetate and propionate.

Examples of particularly preferred silanes are listed in the following Table:

Silane 1

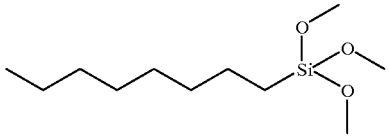

Silane 2

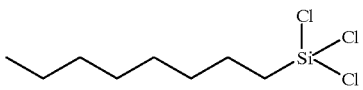

-continued

Silane 3

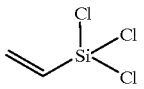

Silane 4

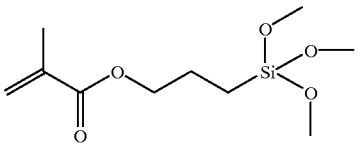

Silane 5

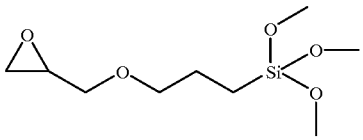

Silane 6

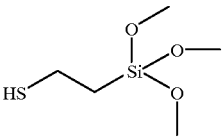

Silane 7

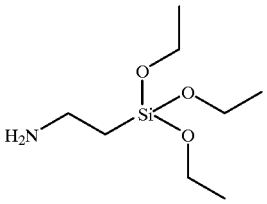

Silane 8

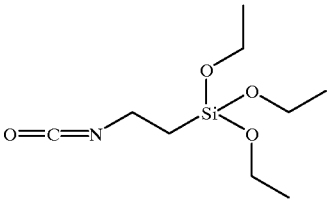

Silane 9

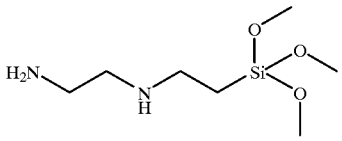

The silane must of course be appropriate for the subsequent polymer coating.

For example, if silanisation is effected with silanes 3 or 4, a silane containing polymerisable double bonds is thus deposited on the magnetisable particles. In this situation, a polymer coating is preferably deposited by the radical polymerisation of monomers, such as acrylic acid esters for example, whereby a firm chemical bond is formed between the silane and the polymer coating. Surfaces which have been modified with silanes 7 or 9 can easily be reacted with compounds containing isocyanate, e.g. with stearyl isocyanate, whereby a polymer coating which contains urea units is produced. Silanisation with silanes 3, 4, 7 and/or 9 is therefore preferred.

The reaction can even be effected simply by mixing the components in customary agitating or mixer units. The temperature during the reaction is preferably within the range from 0° C. to 100° C. and the duration of the reaction is preferably 0.1 hour to 10 hours.

The amount of silane used can be varied within wide limits. It is preferably within the range from 0.01 to 25% by weight, most preferably 0.1 to 10% by weight, with respect to the weight of magnetisable particles.

Silanisation is preferably effected in the presence of at least one aprotic solvent. Examples of suitable solvents include acetone, butanone, dichloromethane, trichloromethane, toluene, ethyl acetate or tetrahydrofuran.

A catalyst may additionally be used during silanisation. Suitable catalysts include protonic acids such as acetic acid or hydrogen chloride, as well as amines such as dicyclohexylamine. The amount of catalyst is preferably 0.01 to 5% by weight with respect to the silane.

The silane used for silanisation may first be hydrolysed, e.g. with molar amounts of water, under conditions of acid catalysis, whereupon the hydrolysable radicals X are converted into OH groups, and the freshly prepared OH compound is then reacted with the magnetisable particles in a solvent.

The present invention further relates to a process for producing the magnetorheological liquids according to the invention, in which the magnetisable particles produced by the process which is also according to the invention and which are coated with an organic polymer are dispersed in an oleophilic liquid, optionally in the presence of a thickener.

In one preferred embodiment of the invention, the carrier liquid is first homogeneously mixed with the thickener with the application of high shearing forces, e.g. preferably at dispersion energies between 50 and 500 W/l, for example by means of an Ultraturrax® obtainable from the IKA-Labortechnik company, Germany, and the coated magnetisable particles are subsequently stirred in.

The present invention additionally relates to the use of the non-aqueous magnetorheological liquids according to the invention in couplings, dampers and/or bearings.

The invention will be explained with reference to the accompanying examples. The invention is not restricted to these examples, however.

EXAMPLES OF APPLICATION

Example 1

Coating of Carbonyl Iron

A silanisation solution was prepared by mixing 200 g gamma-methacryloxypropyltrimethoxysilane, 352 g deionised water and 2.6 g glacial acetic acid for 30 minutes in a glass beaker at room temperature. 1000 g of EN carbonyl iron (obtainable at BASF AG, Germany) having an average particle diameter (measured according to ASTM B 330) of 4–5 $\mu$m and the following contents on impurities like C: 0.8 weight-%, N: 0.8 weight-% and O: 0.3 weight %, were added to 2000 ml butanone in a heatable, 4 liter three-necked flask fitted with a glass stirrer, a thermometer and a high-efficiency condenser, and were treated with the silanisation solution. The mixture was stirred for 16 hours at 40° C. After cooling, the solid was removed by suction in a suction filter, subjected to multiple washings with butanone, and dried for 10 hours at 80° C.

The silanised carbonyl iron was slurried in 2000 ml butanone and treated with 190 g stearyl methacrylate, 10 g ethylene glycol dimethacrylate and 6 g azobutyric dinitrile. The mixture was heated for 2 hours at 70° C. with stirring and was heated for a further 2 hours under reflux. The solid was filtered off after cooling, washed three times with 1500 ml butanone each time, and was dried for 12 hours under vacuum at 50° C.

Example 2

Silanisation of Carbonyl Iron 50 g gamma-aminopropyl-triethoxysilane were dissolved in 1000 ml chloroform. 1000 g EN carbonyl iron (obtainable at BASF AG, Germany) having an average particle diameter (measured according to ASTM B 330) of 4–5 μm and the following contents on impurities like C: 0.8 weight-%, N: 0.8 weight-% and O: 0.3 weight %, were dispersed into this solution at room temperature, and the mixture was allowed to stand for 1 hour and was shaken occasionally. The coated carbonyl iron was subsequently intensively washed with 1000 ml chloroform, and was dried for 1 day at room temperature and at atmospheric pressure, and for 18 hours at 50° C. under high vacuum.

Example 3

Polyurethane Coating of Carbonyl Iron and Production of a Magnetorheological Liquid 32 g silanised carbonyl iron from Example 2 were stirred, together with 0.04 g diazabicyclo[2.2.2]octane, into 8.0 g of a trifunctional polyethylene glycol with a molecular weight of 1015, prepared by the ethoxylation of trimethylolpropane. This mixture was dispersed, by means of an Ultraturrax®, into a solution comprising 0.84 g of the reaction product of 40 parts octamethylcyclotetrasiloxane with 2 parts N-(β-aminoethyl)-γ-aminopropylmethyl-diethoxysilane in 13.3 g silicone oil having a viscosity of 5 $mm^2/s$ at 25° C. (Baysilone® M5, obtainable from Bayer AG, Germany). 2.05 g toluene diisocyanate were added to this dispersion with shearing, followed by dispersing for 30 seconds. The dispersion was subsequently cured for 12 hours at 80° C. to produce a ready-to-use magnetorheological liquid.

We claim:

1. Magnetorheological liquids, comprising magnetizable particles, at least one oleophilic liquid and optionally a thickener, wherein the magnetizable particles are silanized by reaction of the particles with a silane of formula (I)

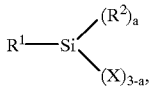

(I)

where $R^1$ is a $C_1$–$C_{20}$-alkyl radical or $C_2$–$C_{20}$-alkylene radical which may optionally be substituted with an amino, isocyanato, methacryloyloxy, acryloyloxy, epoxy or mercapto group, and/or interrupted by —O—, —NH—, —COO— or —NH—COO, $R^2$ represents a phenyl or a $C_1$–$C_6$-alkyl radical, X represents a hydrolysable group, and a assumes the value 0, 1 or 2, and are coated with an organic polymer selected from the group consisting of vinyl polymers, polyureas, polyurethanes and combinations thereof.

2. Magnetorheological liquids according to claim 1, comprising 45 to 98% by weight of magnetizable particles coated with an organic polymer, 2 to 45% by weight of an oleophilic liquid, and 0 to 20% by weight of a thickener, wherein the sum of the percentages by weight is 100% by weight of total magnetorheological liquid.

3. Magnetorheological liquids according to claim 1, wherein the average longest dimension of the magnetizable particles which are coated with an organic polymer of the particles, is 0.1 to 100 μm, said average being the weight-average.

4. Magnetorheological liquids according to claim 1, wherein the coating comprises 0.1 to 50% by weight of the coated magnetizable particles.

5. Magnetorheological liquids according to claim 1, wherein the magnetizable particles comprise iron, iron alloys or combinations thereof.

6. Magnetorheological liquids according to claim 1, wherein a thickener is present and the thickener is selected from the group consisting of gels, silicates, metal oxides, microdispersed hydrated silicas obtained by flame hydrolysis with an average particle diameter less than 1 μm and combinations thereof.

7. Magnetorheological liquids according to claim 1, wherein the amount of thickener is 0.1 to 20% by weight of magnetorheological liquid.

8. Magnetorheological liquids according to claim 1, wherein the oleophilic liquid is at least one mineral oil or at least one silicone oil.

9. A process for producing magnetizable particles for magnetorheological liquids coated with organic polymer, which comprises silanizing said particles by reaction of the particles with a silane of formula (I)

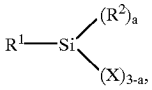

(I)

where $R^1$ is a $C_1$–$C_{20}$-alkyl radical or $C_2$–$C_{20}$-alkylene radical which may optionally be substituted with an amino, isocyanato, methacryloyloxy, acryloyloxy, epoxy or mercapto group, and/or interrupted by —O—, —NH—, —COO— or —NH—COO, $R^2$ represents a phenyl or a $C_1$–$C_6$-alkyl radical, X represents a hydrolysable group, and a assumes the value 0, 1 or 2, and then reacting organic monomer constituents in the presence of the magnetizable particles to form an organic polymer on said particles by means of polycondensation, polyaddition or polymerization.

* * * * *